US007010821B1

(12) United States Patent
Leach

(10) Patent No.: US 7,010,821 B1
(45) Date of Patent: Mar. 14, 2006

(54) EXPANDABLE DOUBLE NURSING PILLOW

(76) Inventor: Jamie S. Leach, P.O. Box 717, 130 E. 10th St., Ada, OK (US) 74820

( * ) Notice: Subject to any disclaimer, the term of this patent is extended or adjusted under 35 U.S.C. 154(b) by 0 days.

(21) Appl. No.: 11/099,032

(22) Filed: Apr. 6, 2005

(51) Int. Cl.
*A47G 9/00* (2006.01)

(52) U.S. Cl. ..... 5/655; 5/640; 5/636

(58) Field of Classification Search ..... 5/655, 5/636, 632, 630, 639, 640, 644
See application file for complete search history.

(56) References Cited

U.S. PATENT DOCUMENTS

| | | | | |
|---|---|---|---|---|
| 726,164 | A | 4/1903 | Hogan et al. | |
| D124,296 | S | 12/1940 | Thompson | |
| 2,336,707 | A | 12/1943 | Thompson | |
| 4,236,264 | A * | 12/1980 | Britzman | 5/640 |
| D318,969 | S | 8/1991 | Byrn | |
| 5,154,649 | A | 10/1992 | Pender | |
| 5,519,906 | A | 5/1996 | Fanto-Chan | |
| 5,581,833 | A | 12/1996 | Zenoff | |
| D413,751 | S | 9/1999 | Alyea | |
| D443,461 | S | 6/2001 | Hall et al. | |
| 6,279,185 | B1 | 8/2001 | Matthews | |
| 6,412,128 | B1 | 7/2002 | Matthews | |
| 6,484,337 | B1 | 11/2002 | Moe et al. | |
| 6,532,612 | B1 | 3/2003 | Matthews Brown | |
| 6,658,681 | B1 * | 12/2003 | Britto et al. | 5/655 |
| 6,711,770 | B1 | 3/2004 | Owens et al. | |
| 6,760,934 | B1 | 7/2004 | Leach | |
| 2004/0060116 | A1 | 4/2004 | Matthews Brown | |

* cited by examiner

*Primary Examiner*—Alexander Grosz

(57) ABSTRACT

An expandable double nursing pillow provided with two substantially kidney shaped arms and a central elasticized portion to support single or twin infants and accommodate a variety of users having variable sizes, the central elasticized portion having two ends, each end thereof connecting to an arm having a substantially kidney shape, each kidney-shaped arm terminating in an end thereof, the central elasticized portion being provided with one or more elastic members therein so as to provide flexibility and adjustability along the central elasticized portion of the pillow, the central elasticized portion in combination with the two substantially kidney-shaped arms creating an interior well of sufficient diameter to encompass the torso of an adult user, the expandable double nursing pillow being adapted to permit various positioning options to facilitate cradling or nursing of one or two infants simultaneously while accommodating a plurality of body types of the adult user.

9 Claims, 4 Drawing Sheets

Fig. 1
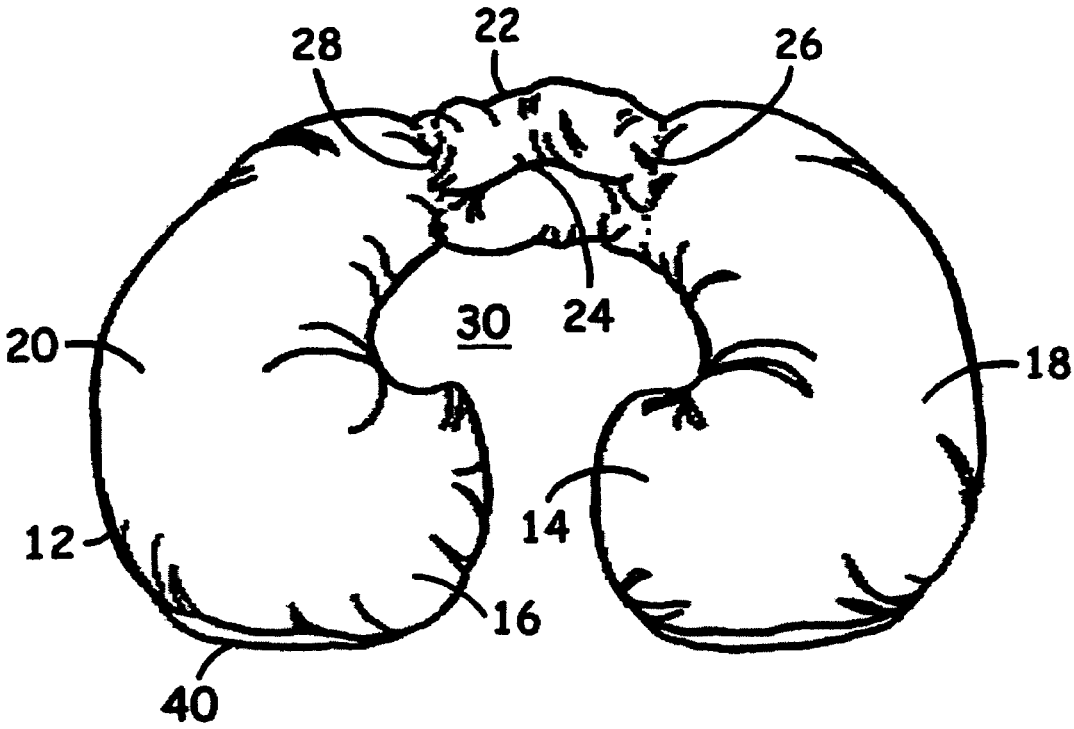
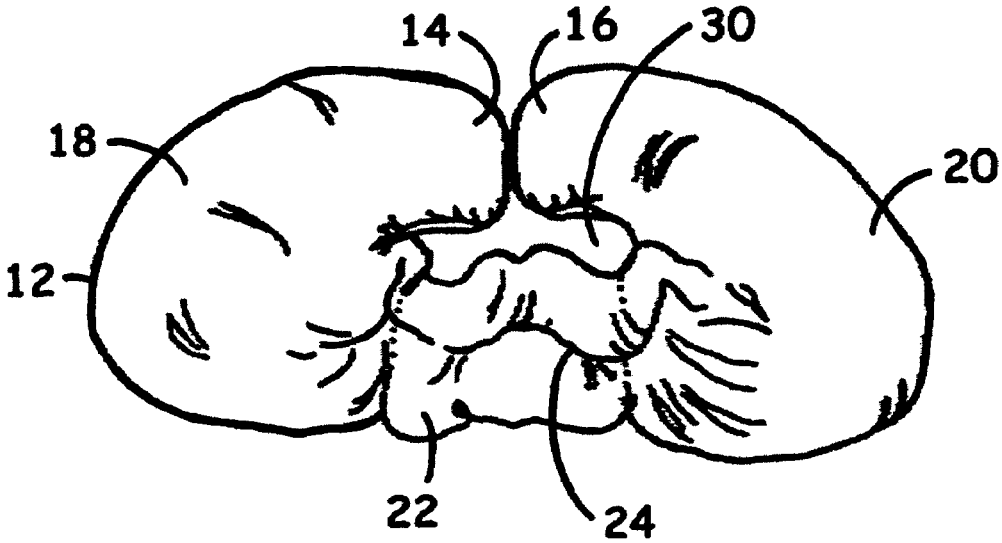
Fig. 2

EXPANDABLE DOUBLE NURSING PILLOW

BACKGROUND OF THE INVENTION

1. Field of the Invention

The present invention relates to an expandable double nursing pillow for mothers of twins. More particularly, the present invention involves a contoured body pillow adapted to accommodate twins, the pillow having two symmetrically contoured substantially kidney shaped arms with an elasticized central portion located between the arms.

2. Prior Art

There are a number of patents that show or relate to support pillows in general. Some of the support pillows are designed particularly for infants, some particularly for small children and some especially for adults. It is believed to be novel to provide a contoured body pillow with substantially kidney shaped arms and a central elasticized portion to support twin infants and to accommodate a variety of users having variable sizes. A preliminary patentability search was conducted on this invention and the following listed references were uncovered in the search.

| U.S. Pat. No. | Inventor | Issue Date |
|---|---|---|
| Des. 124,296 | B. Thompson | Dec. 24, 1940 |
| Des. 318,969 | Byrn | Aug. 13, 1991 |
| Des. 413,751 | Alyea | Sep. 14, 1999 |
| U.S. Pat. No. D443,461 S | Hall et al | Jun. 12, 2001 |
| 726,164 | D. Hogan et al | Apr. 21, 1903 |
| 2,336,707 | E. Thompson | Dec. 14, 1943 |
| 5,154,649 | Pender | Oct. 13, 1992 |
| 5,519,906 | Fanto-Chan | May 28, 1996 |
| 5,581,833 | Zenoff | Dec. 10, 1996 |
| U.S. Pat. No. 6,279,185 B1 | Matthews | Aug. 28, 2001 |
| U.S. Pat. No. 6,412,128 B1 | Matthews | Jul. 2, 2002 |
| U.S. Pat. No. 6,484,337 B1 | Moe et al | Nov. 26, 2002 |
| U.S. Pat. No. 6,532,612 B2 | Matthews Brown | Mar. 18, 2003 |
| U.S. Pat. No. 6,711,770 B1 | Owens et al | Mar. 20, 2004 |
| U.S. Pat. No. 6,760,934 B1 | Leach | Jul. 13, 2004 |
| U.S. Pat. No. 2004/00606116 A1 | Matthews Brown | Apr. 1, 2004 |

The above patents are not considered to be particularly pertinent to the present invention.

Thompson U.S. Pat. No. 2,336,707 discloses a curved pillow having a central compressible section therein. The pillow is designed to rest on the users shoulders and be received around the neck of the user with the compressible portion adapted to fit against the neck.

Alyea Design Pat. No. 413,751 discloses a substantially U-shaped nursing pillow which discloses straps for securing two infants to the pillow.

Zenoff U.S. Pat. No. 5,581,833 discloses a support pillow with lumbar support for use in nursing and other applications.

Matthews U.S. Pat. No. 6,279,185 B1 discloses a resilient substantially circular support pillow and methods for making the same. The Matthews pillow may be used for nursing or feeding of infants.

Matthews U.S. Pat. No. 6,412,128 B1 is a continuation of the U.S. Pat. No. 6,279,185 B1 patent.

Moe, et al U.S. Pat. No. 6,484,337 B1 discloses a lamaze pillow that has a pillow portion for surrounding a user's body and an elasticized strap for securing around the back of a user. Moe, et al., further discloses a detachable set member and can be used to nurse an infant.

Matthews Brown U.S. Pat. No. 6,532,612 B2 discloses an infant support pillow which is utilized to secure an infant in a sitting or reclining position.

SUMMARY OF THE INVENTION

An expandable double nursing pillow is provided, having two substantially kidney shaped arms and a central elasticized portion to support twin infants and accommodate a variety of users having variable sizes, the central elasticized portion having two ends, each end thereof connecting to an arm having a substantially kidney shape, each kidney-shaped arm terminating in an end thereof. Each substantially kidney-shaped arm comprises a bell-shaped upper portion and a curved lower portion and consisting of a rounded pillow with fiberfill, batting (or alternate type) filler material having sufficient density to create a rounded pillow provided with a wide terminating end having a beveled edge and a non-terminating end of each kidney-shaped arm tapering convergingly inward to meet with a central elasticized portion, the elasticized portion having two opposite ends, each end being connected to one of two substantially kidney-shaped arms. The central elasticized portion is provided with one or more elastic members therein so as to provide flexibility and adjustability along the back portion (central elasticized portion) of the pillow. The central elasticized portion in combination with the two substantially kidney-shaped arms creates an interior well of sufficient diameter to encompass the torso of an adult user.

The expandable double nursing pillow of the present invention is intended to permit optimal positioning to facilitate cradling or nursing of one or two infants simultaneously while accommodating a plurality of body types of the adult user, thereby allowing a variety of sizes of adult users to utilize a single size pillow. The expandable double nursing pillow wraps around the torso or mid-section of the adult user to create a sensation of closeness while providing support for a nursing or resting infant. When the expandable double nursing pillow is wrapped around the torso of an adult user, the ends of the two substantially kidney-shaped arms provide a support pillow on which one or two infants may recline. In this position, it is possible for a mother of twins to have one infant situated on each arm of the pillow for nursing or cradling purposes. When the expandable double nursing pillow is pulled taut around the torso of the adult user, the central elasticized portion provides back support for the adult user and permits the substantially kidney-shaped arms to overlap, thereby creating a propping support for an infant. Depending on the size of the user and the degree to which the central elasticized portion is stretched, one substantially kidney-shaped arm could go around the front of the user to overlap the opposite substantially kidney-shaped arm. In this position, additional support could be provided to a single nursing infant or to cradle the infant in a more upright position.

BRIEF DESCRIPTION OF THE DRAWINGS

FIG. 1 is a top view of the expandable double nursing pillow of the present invention.

FIG. 2 is a perspective view taken from the back of the expandable double nursing pillow of the present invention.

DETAILED DESCRIPTION OF THE PREFERRED EMBODIMENTS

Figure 4:
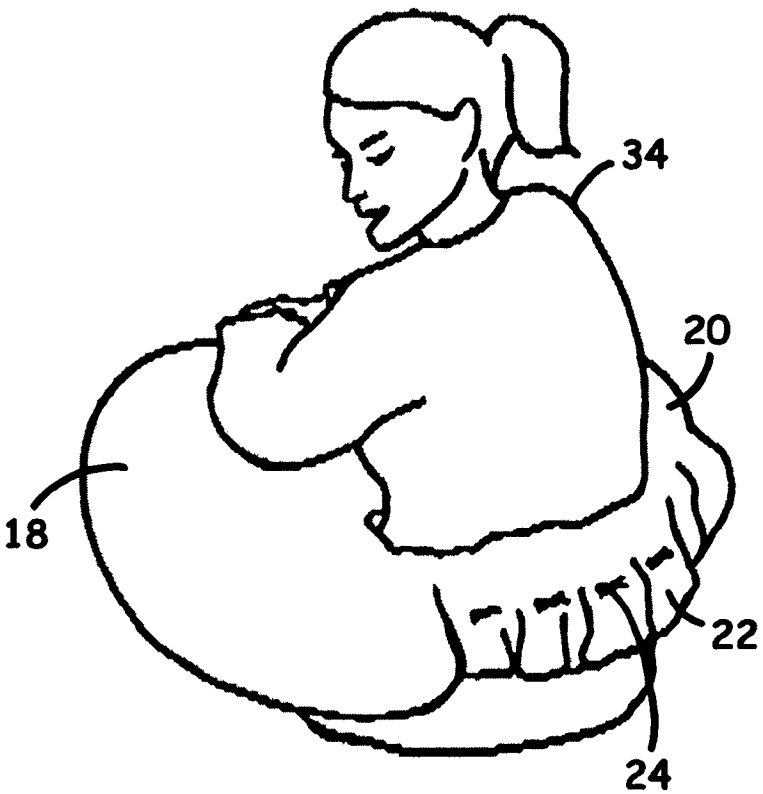
FIG. 4 is a perspective view from the side of a petite woman having the expandable double nursing pillow wrapped around her waist.

Referring to the drawings in detail, FIG. 1 shows a top view of the expandable double nursing pillow 12 consisting of two substantially kidney-shaped arms 18 and 20 connected to an elasticized central portion 22 which elasticized central portion 22 may be provided with a thin layer of batting or consist entirely of fabric or similar material, the elasticized central portion 22 being provided with one or more elastic members 24 therein, the elastic members are created by stitching or otherwise affixing a length of fabric (equal to the length of a fully expanded section of elastic) to a fully expanded elastic and subsequently released to form a gathered appearance with expandable features, the elasticized central portion 22 having two ends which connect with two non-terminal ends 26 and 28 of the substantially kidney-shaped arms 18 and 20, each substantially kidney-shaped arm being provided with a non-terminal end 26 and 28 and a terminal end 14 and 16 located at the opposite end of the arm and having a beveled edge or seam 40, the beveled edge or seam 40 continuing along the perimeter of the substantially kidney-shaped arm to create a sufficiently wide surface on which to rest an infant (as will hereinafter appear), each substantially kidney-shaped arm 18 and 20 comprising a bell-shaped upper (non-terminal) portion and a curved lower (terminal) portion to form an overall kidney-shape of the substantially kidney-shaped arms 18 and 20, the substantially kidney-shaped arms 18 and 20 in combination with the elasticized central portion 22 of the expandable double nursing pillow 12 forming an interior well 30 of sufficient size to encompass the torso of an adult user as will hereinafter appear.

FIG. 2 shows a back view of the expandable double nursing pillow 12 having the central elasticized section or portion 22 provided with one or more elastic members 24 affixed therein, two substantially kidney-shaped curved arms 18 and 20 extending from either side of the central elasticized portion 22 and connecting thereto at non-terminal ends 26 and 28 and terminating at opposite ends thereof in beveled ends 14 and 16. The substantially kidney-shaped curved arms 18 and 20 combine with the central elasticized portion 22 to create the interior well 30 within the interior circumference of the pillow where the user (not shown) will be positioned.

Figure 3:
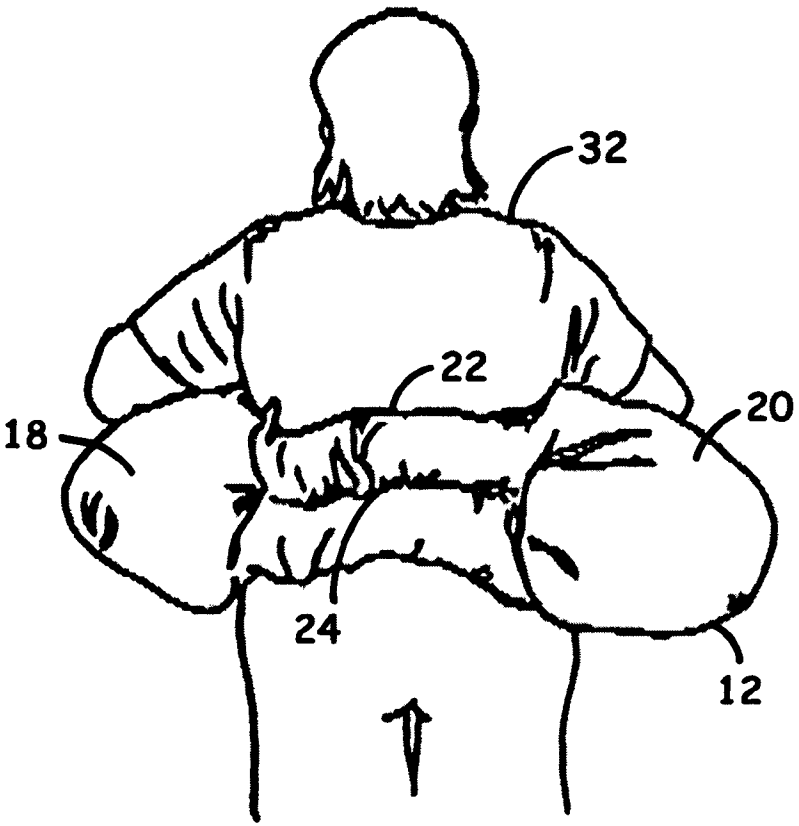
FIG. 3 is a back view of a full-figured adult woman having the expandable double nursing pillow of wrapped around her waist.

FIG. 3 shows a back view of the expandable double nursing pillow 12 wrapped around the waist or midsection of a full-figured woman 32, the interior well portion 30 encompassing the torso of the full-figured woman 32 by means of stretching the elastic member(s) 24 contained within the central elasticized portion 22 to fit against the back (not numbered) of the woman 32, the substantially kidney-shaped arms 18 and 20 of the expandable nursing pillow 12 wrapping around the sides and front of the woman 32 with the terminal ends 14 and 16 of the substantially kidney-shaped arms 18 and 20 meeting at the front of the woman 32.

FIG. 4 shows a perspective view of the expandable double nursing pillow 12 wrapped around the waist or midsection of a petite woman 34, the interior well portion 30 encompassing the torso of the petite woman 34 by means of relaxing the elastic member(s) 24 contained within the central elasticized portion 22 to fit against the back (not numbered) of the petite woman 34, the substantially kidney-shaped arms 18 and 20 of the expandable nursing pillow 12 wrapping around the sides and front of the woman 34 with the terminal ends 14 and 16 of the substantially kidney-shaped arms 18 and 20 meeting at the front of the woman 34.

Figure 5:
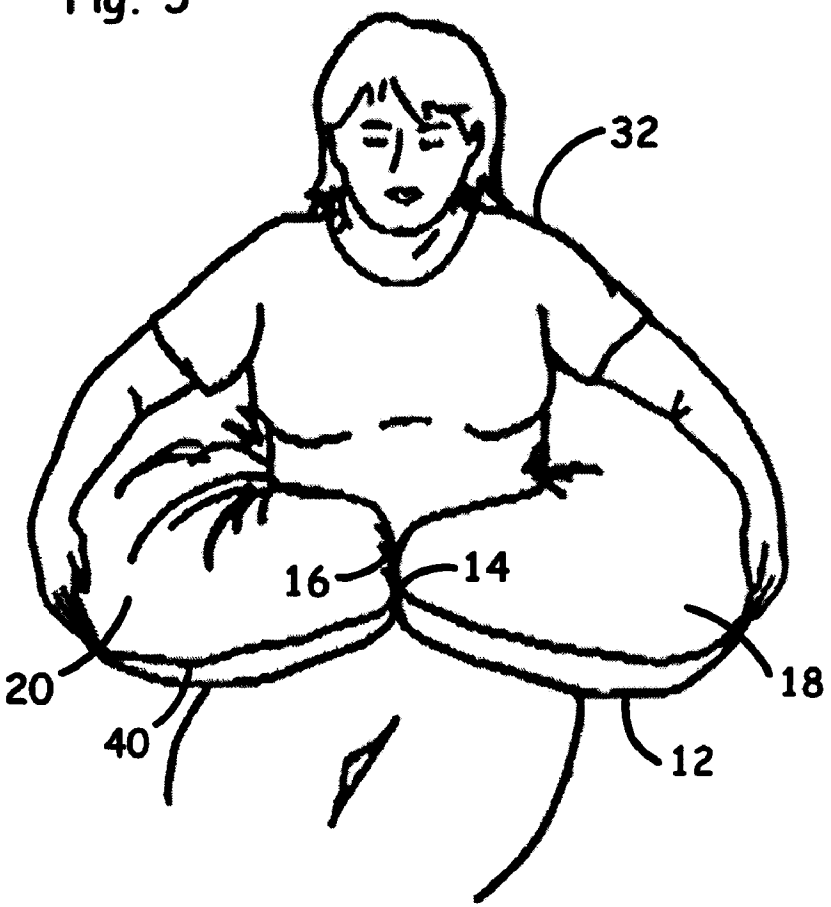
FIG. 5 is a front perspective view of the woman portrayed in FIG. 3 showing the expandable double nursing pillow wrapped around her waist in a seated position.

FIG. 5 is a front view of the expandable double nursing pillow 12 wrapped around the waist or midsection of the full-figured woman 32, the interior well portion 30 (not visible in this Figure) encompassing the torso of the full-figured woman 32 as described in FIG. 3, the substantially kidney-shaped arms 18 and 20 of the expandable nursing pillow 12 are provided with a beveled edge or seam 40 which extends along the perimeter of the substantially kidney-shaped arms 18 and 20 and creates a substantially flat pillow surface on which an infant may be placed (as will hereinafter appear), the substantially kidney-shaped arms 18 and 20 wrap around the sides and front of the full-figured woman 32 with the terminal ends 14 and 16 of the substantially kidney-shaped arms 18 and 20 meeting at the front of the woman 32.

Figure 6:
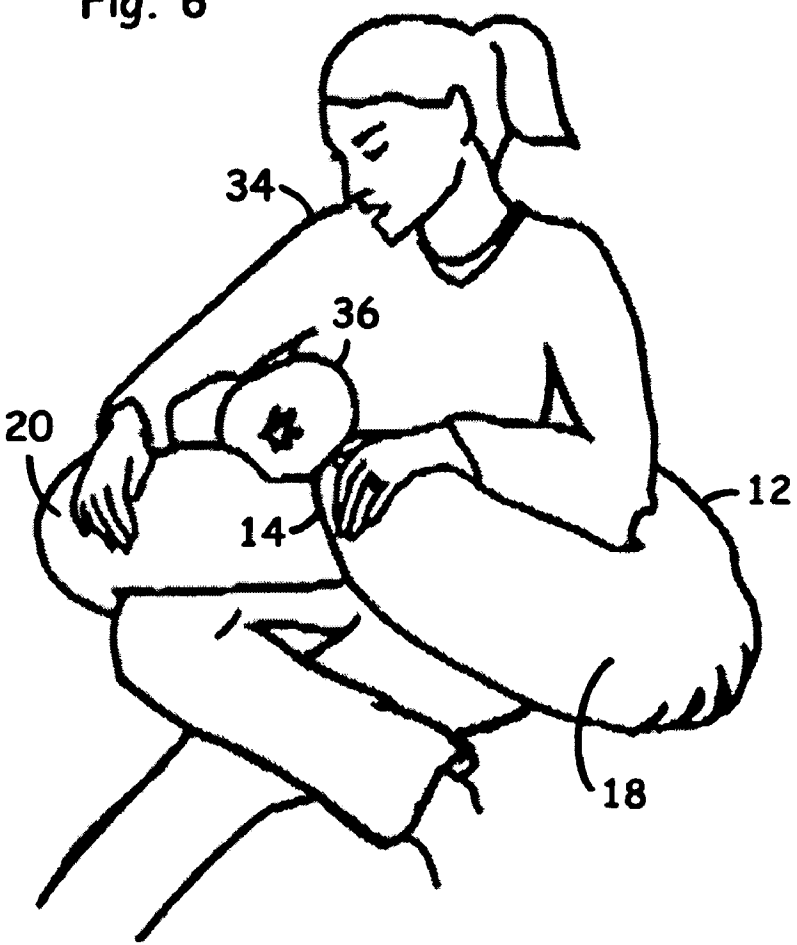
FIG. 6 is a front perspective view of the woman portrayed in FIG. 4 showing the expandable double nursing pillow wrapped around her waist and an infant positioned on one arm of the pillow.

FIG. 6 is a perspective view taken from the front showing the expandable double nursing pillow 12 wrapped around the waist or midsection of the petite woman 34, the interior well portion 30 (not visible in this Figure) encompassing the torso of the petite woman 34 as described in FIG. 4, the substantially kidney-shaped arms 18 and 20 of the expandable nursing pillow 12 wrapping around the sides and front of the petite woman 34 with the terminal ends 14 and 16 of the substantially kidney-shaped arms 18 and 20 meeting at the front of the woman 34, the woman 34 holds an infant 36 who is reclining on the substantially kidney-shaped arm 20 of the expandable nursing pillow 12, the head of the infant 36 being placed toward the terminal beveled end 16 (not numbered in this Figure) of the substantially kidney-shaped arm 20 so as to locate the infant 36 in an optimal position for nursing from the woman (mother) 34.

Figure 7:
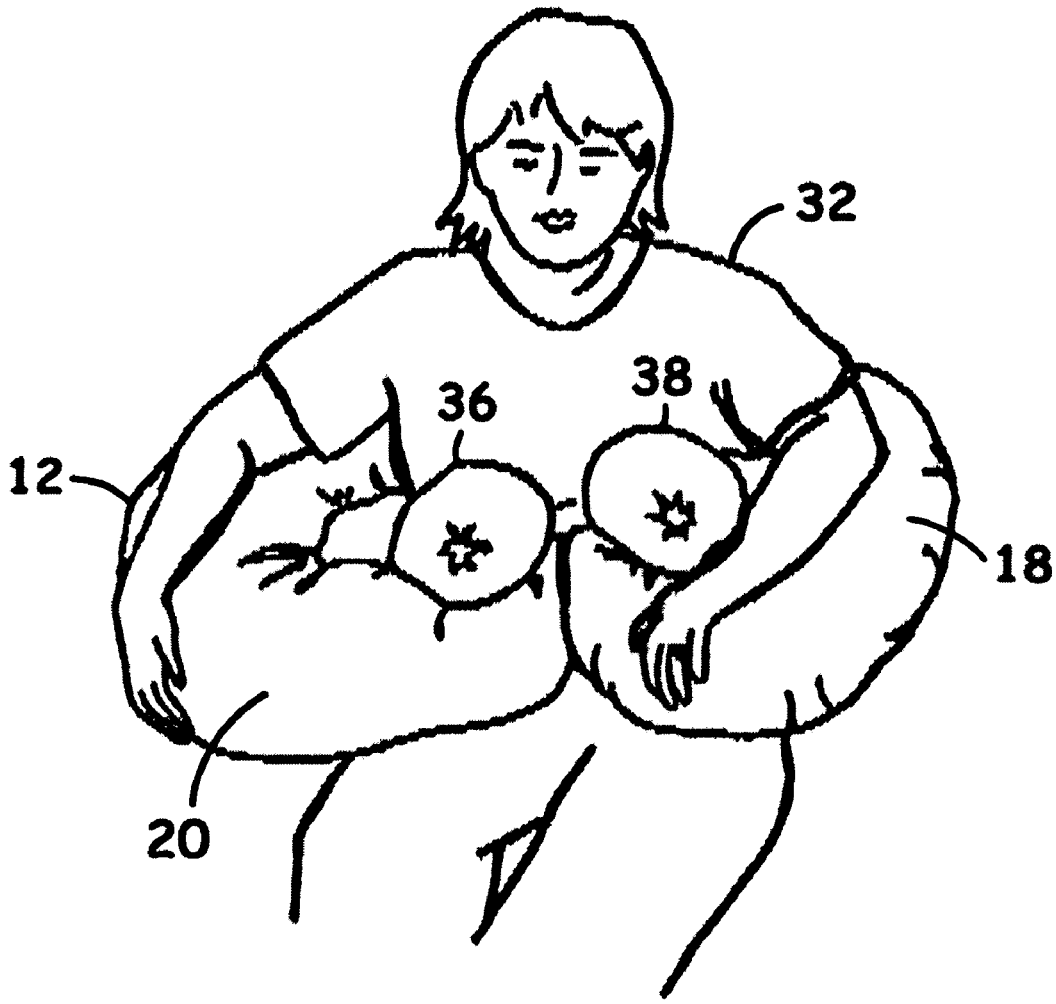
FIG. 7 is a front perspective view of the woman portrayed in FIGS. 3 and 5 showing the expandable double nursing pillow wrapped around her waist and two infants positioned on the arms of the pillow, one infant being positioned on each arm thereof.

FIG. 7 is a perspective view taken from the front showing the expandable double nursing pillow 12 wrapped around the waist or midsection of the full-figured woman 32, the interior well portion 30 (not visible in this Figure) encompassing the torso of the full-figured woman 32 as described in FIG. 3, the substantially kidney-shaped arms 18 and 20 of the expandable nursing pillow 12 wrapping around the sides and front of the woman 32 with the terminal ends 14 and 16 of the substantially kidney-shaped arms 18 and 20 meeting at the front of the woman 32, the woman 32 holds two (twin) infants 36 and 38 who are reclining on the substantially kidney-shaped arms 18 and 20 of the expandable nursing pillow 12, the head of the infants 36 and 38 being placed toward the terminal beveled ends 14 and 16 (not numbered in this Figure) of the substantially kidney-shaped arms 18 and 20 so as to locate the infants 36 and 38 in an optimal position for nursing simultaneously from the woman (mother) 32.

The addition of a means for securing the terminal ends 14 and 16 of the substantially kidney-shaped arms 18 and 20 to one another by use of hook and loop fastener, fabric ties, or other means is contemplated by the present invention, although not shown in FIGS. 1 through 7. While FIGS. 1 through 7, inclusive, depict the various positions and uses which may be achieved with the expandable double nursing pillow 12 of the present invention, it should be apparent that other and further positions, uses, and modifications of the present invention, apart from those shown or suggested herein, may be made within the spirit and scope of this invention.

What is claimed is:

1. An expandable double nursing pillow comprising a first substantially kidney-shaped arm having a terminal end and a non-terminal end, the first substantially kidney-shaped arm connecting at the non-terminal end thereof to one end of a central elasticized portion, the central elasticized portion having an opposite end connected to a non-terminal end of a second substantially kidney-shaped arm, the two substantially kidney-shaped arms in conjunction with the central elasticized portion forming an interior well of sufficient size to encompass the torso of an adult user.

2. An expandable double nursing pillow as set forth in claim 1 wherein the central elasticized portion is provided with one or more elastic members connected thereto along its length in expanded condition to facilitate adjustability of the central elasticized portion by the gathering or expansion thereof so as to accommodate a plurality of sizes and shapes of users.

3. An expandable double nursing pillow as set forth in claim 1 wherein a non-terminal end of the substantially kidney-shaped arm attaches to the central elasticized portion and flares outward in a substantially bell shape, the bell shape transitioning into a curve, the curved shape terminating at a terminal end in a beveled seam, the beveled seam continuing along the perimeter of the substantially kidney-shaped arm.

4. An expandable double nursing pillow as set forth in claim 1 wherein the torso of an adult person is adapted to be received within the interior well created by the two substantially kidney-shaped arms in conjunction with the central elasticized portion.

5. An expandable double nursing pillow as set forth in claim 4 wherein the central elasticized portion of the pillow is pulled taut against the back of an adult person within the well and one substantially kidney-shaped arm may be placed in a position such that the first arm overlaps the second arm, the first arm being in an angled position and adapted to receive an infant in a sitting position thereon.

6. An expandable double nursing pillow as set forth in claim 1 wherein an infant is adapted to be received in a supine position on the substantially kidney-shaped arm with the head of the infant resting toward the terminal end of the substantially kidney-shaped arm of the pillow while the torso of an adult person is received within the well of the pillow so as to secure the infant in an optimal nursing position.

7. An expandable double nursing pillow as set forth in claim 1 wherein two (potentially twin) infants are adapted to be received in a supine position on each of the two substantially kidney-shaped arm with the head of each infant resting toward the terminal end of his respective substantially kidney-shaped arm of the pillow while the torso of an adult person is received within the well of the pillow so as to secure both infants in an optimal simultaneous nursing position.

8. An expandable double nursing pillow as set forth in claim 1 wherein an infant is adapted to be received in a supine position on the first substantially kidney-shaped arm with the lower torso and legs of the infant resting toward the terminal end of the first substantially kidney-shaped arm of the pillow and the head and upper back of the infant is received against the body of an adult person, the body of the adult person being received within the well of the pillow so as to secure the infant in an optimal cradling position.

9. An expandable double nursing pillow as set forth in claim 1 wherein two (potentially twin) infants are adapted to be received in a supine position on each of the two substantially kidney-shaped arm with the lower torso and legs of each infant resting toward the terminal end of his respective substantially kidney-shaped arm of the pillow and the head and upper back of each infant is received against the body of an adult person, the body of the adult person being received within the well of the pillow so as to secure both infants in an optimal simultaneous cradling position.

* * * * *